US006246917B1

(12) United States Patent
Smith et al.

(10) Patent No.: US 6,246,917 B1
(45) **Date of Patent: *Jun. 12, 2001**

(54) ELECTRONIC SCORING PROCESS

(76) Inventors: Kenneth D. Smith, 10725 Garland Ave., Culver City, CA (US) 90232; James C. Jakubowski, 5313 Janisann Ave., Culver City, CA (US) 90230

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/972,234

(22) Filed: Nov. 18, 1997

Related U.S. Application Data

(60) Provisional application No. 60/031,056, filed on Nov. 18, 1996.

(51) Int. Cl.[7] ..... A63F 9/24

(52) U.S. Cl. ..... 700/92; 473/409; 340/323 R

(58) Field of Search ..... 473/131, 407, 473/409, 55, 54, 70; 340/323 R, 323 B; 273/148 R, DIG. 26; 463/1, 29, 30, 25, 40, 42; 235/375, 380, 382; 364/410.1, 411.1; 700/91–93

(56) References Cited

U.S. PATENT DOCUMENTS 3,665,494 * 5/1972 Baumoel .
4,268,744 * 5/1981 McGeary .
4,319,131 * 3/1982 McGeary et al. .
4,764,666 * 8/1988 Bergeron .
4,910,677 * 3/1990 Remedio et al. ..... 700/91
5,127,044 * 6/1992 Bonito et al. ..... 473/407
5,179,517 * 1/1993 Sarbin et al. .
5,231,568 * 7/1993 Cohen et al. ..... 463/29
5,245,537 * 9/1993 Barber .
5,319,548 * 6/1994 Germain ..... 473/407
5,373,440 * 12/1994 Cohen et al. ..... 463/25
5,429,361 * 7/1995 Raven et al. ..... 463/29
5,536,010 7/1996 Lambourne .
5,562,550 * 10/1996 Chartrand ..... 473/131
5,770,533 * 6/1998 Franchi ..... 463/42
5,779,549 * 7/1998 Walker et al. ..... 463/29

* cited by examiner

*Primary Examiner*—Mark Sager
(74) *Attorney, Agent, or Firm*—Bruce A. Jagger

(57) ABSTRACT

An electronic scoring process which comprises assigning a smart card to a player, and opening an electronic record for that smart card at least one a master facility. The master facility is adapted to receive, store, calculate and report play related data. At the initiation of a round of play, a player presents the smart card to a site specific smart card imprinter. At that time the status of the smart card is determined, and it is imprinted with current site specific information. The smart card is again presented to and read by a mobile score keeping unit. As play progresses, data is fed into the mobile unit on a real time basis, and an electronic recording of play related data is generated by the mobile unit. At the conclusion of play the electronic recording is imprinted onto the smart card. The smart card is read by a card reader and the electronic recording is transmitted to one or more master facilities where it is added to the electronic record for that smart card at that facility. Periodically a report is compiled from the electronic record, and provided to the player.

6 Claims, 2 Drawing Sheets

Fig. 1

ELECTRONIC SCORING PROCESS FLOW CHART

| Player | Site Of Play | Association | Issuing Site |
|---|---|---|---|
| Acquires a personal smart card for data gathering purposes | Generally supplies the requested smart card | Enrolls the player, if not previously enrolled | Opens a record for the requested smart card |
| Presents smart card before play starts | Imprints smart card with current site specific information | NA | NA |
| Presents smart card to real time recorder to initiate data gathering | Provides real time data recorder | NA | NA |
| Enters data into real time recorder as play progresses | NA | NA | NA |
| At end of play retrieves data from real time recorder and imprints on smart card | NA | NA | NA |
| After play is concluded, transmits data from smart card to master databases | Provides equipment to permit transmission of data to master databases | Accepts transmitted Data and adds it to the player's records | Accepts transmitted data and stores for purposes of compiling periodic reports |
| NA | NA | Provides periodic reports to player of Association specific information for standing purposes | Provides full detailed periodic reports to player for game improvement purposes |
| For tournament play, when applicable, presents smart card to a tournament scoring unit before and after play | Provides tournament scoring unit and information display equipment | NA | NA |
| For score comparison for a round of play, when desired, presents smart card to a comparison unit and selects applicable comparison criteria | Provides score comparison unit to enable score comparison under the predetermined comparison criteria | NA | NA |
| For a new round of play, the smart card is presented before play starts, and the data from the previous round is transmitted to the master databases if not done previously | Imprints smart card with current site specific information, and refuses permission to play until data from last round has been transmitted to master databases | NA | NA |
| Additional information, such as membership, transaction, credit, medical information, and the like, can optionally also be imprinted on the smart card | May be involved in, for example, credit transactions | May be involved in membership related matters | May be involved in providing other services |

ELECTRONIC SCORING PROCESS

This application claims priority based on Kenneth D. Smith and James C. Jakubowski United States Provisional Patent Application Serial No. 60/031,056, filed Nov. 18, 1996, for Electronic Scoring Process.

BACKGROUND OF THE INVENTION

1. Field of the Invention.

The invention relates in general to electronic score keeping, and, in particular, to electronic score keeping wherein a smart card is employed to facilitate the keeping of a detailed electronic record of play and other comparative information.

2. Description of the Prior Art.

Scores and standings have been complied and kept for the play of a wide variety of games. Some games, such as, for example, golf or bowling, require considerable continuously updated information to accurately compute handicaps. The burden of record keeping and calculation is substantial. Current information is often not available in time to contribute significantly to the improvement of a players game.

Various expedients have been proposed for the purpose of score keeping. See, for example, Lambourne U.S. Pat. No. 5,536,010, which proposes an electronic golf score card. Such devices are not effective in tracking and calculating information, such as handicaps, from a long series of rounds of play, particularly when carried out between different players at different sites. There is a need for accurate, timely, comprehensive and permanent information for the scoring of athletic events.

Those concerned with these problems recognize the need for an improved score and record keeping process.

BRIEF SUMMARY OF THE INVENTION

A preferred embodiment of the electronic scoring process according to the present invention comprises the employment of a smart card which acts to receive, store, transport, and present information for electronic access, at least one master facility where electronic records are received, stored, compiled, calculations are performed, and reports are generated, and various smart card imprinting and reading devices located generally at the site of play. As applied, for example, to the game of golf, a smart card is, for example, issued to a player and an electronic record is established at one or more master facilities for that smart card. The smart card contains some identifying electronic indicia which sets it apart from all other such smart cards. The smart card (as is well known) is capable of storing information in an electronic, optical or magnetic media, or the like, in such a form that it can be read and written to.

When a player arrives at the site (golf course) where the next round of golf is to be played, the smart card is preferably presented to and read by an appropriate (well known) card reader device. If desired, the smart card can be presented at any other time while the player is at the site or venue, such as, for example, after a round of play has been completed. Typically, the information on the card which is read includes at least the player's handicap. When the card is so presented it is also generally imprinted with current information concerning the golf course (hole distance, and the like). Also, preferably, the card is imprinted with the fact that a round of golf is to be played. Preferably, the card will not be accepted for the initiation of another round of golf until the information concerning the details of the about to be played round have been transmitted to all of the applicable master facilities, and the fact of such transmission has been written back to the smart card.

Mobile electronic scoring devices which can read from and write to the smart cards, as well as record the details of play, are provided by the site administrator. The players carry these mobile devices with them, recording the details of play as they go. Preferably, before the initiation of play, each player presents that player's smart card to the mobile electronic scoring device to be read. The presentation can take place at any time during the round of play provided the information for each player is segregated so that it can be processed separately. The device is thus updated with the player's identity, handicap, and the specific course information which is peculiar to that site that day. The site information is preferably imprinted from a centrally located site specific unit onto the smart card, and from the smart card into the mobile electronic scoring device. Such site specific information, can, if desired, be transmitted by other means. As play progresses, each player enters the details of that player's game into the mobile electronic scoring device. At the end of play, the mobile scoring device preferably downloads the electronic recording which contains the information about each player's game onto that player's smart card. The player then takes the smart card to a reader which reads the electronic recording and transmits all or part of it to the master facilities where it is added to the electronic records which are associated with that particular smart card. Some master facilities may be concerned with only a part of the electronic recording, so only the data which is of concern is transmitted. Transmission to the master facilities generally is accomplished using conventional devices such as, for example, modems coupled to telephone systems, and the like. The mobile scoring devices which are provided by the venue can, for example, take the form of battery powered devices mounted on golf carts. The information can be stored in these mobile devices until the conclusion of play or it can be written directly to the smart cards as play progresses. If these devices are provided with sufficient computational power, the entire round can be stored, calculated and displayed as play progresses, so that scores and statistics are presented in real time during the course of play. The electronic recording can be, if desired, transmitted in other ways to the readers or master facilities, for example, by radio, optical or sonic means during or after play.

The information contained in the electronic recording for the game of golf generally includes, for example, at least the number of holes played, the number of par 3's, 4's and 5's played, average score per hole and per type of hole, number of eagles, birdies, pars, bogeys, doubles, triples and other scores, number of putts, number of putts per hole and type of hole, minimum and maximum score per round, minimum and maximum number of putts per round, average score per round, number of fairways hit in regulation, number of greens hit in regulation, number of penalty strokes and average per round, number of sand traps hit and percentage of sand saves per round, average course rating, average slope rating, minimum and maximum course rating.

The information gathered for the game of bowling generally includes, for example, total number of lines bowled, average score per line, total number of strikes, average number of strikes per line, total number of spares, average number of spares per line, average number of pins knocked down with the first ball, number of spares made by number of pins remaining after first ball, spares made and missed by number and type of spares left, bowling average by practice line, bowling average by league bowled in, and composite average for all lines bowled.

The one or more master facilities which receive the electronic recordings of the details of play can use them for different purposes. A facility may, for example, periodically compile a detailed report with recommendations by a pro as to how to improve. A facility which is charged with administering, for example, handicaps, can use the electronic recording to establish a handicap for a player as against the handicaps of all of the other players whose play it administers.

Where tournament play is involved, a tournament scoring unit is generally provided at the site of play. After play is completed, all of the electronic recordings are read from the respective smart cards into the tournament scoring unit. Sufficient computational power is provided in the tournament scoring unit to accomplish the necessary computations to determine the outcome of the tournament. Conventional PC computers possess more than enough computing power to accomplish the necessary computations using conventional software.

Score comparisons between players can be accomplished by reading the electronic recordings on the respective player's smart cards into score comparison units. These units can be the same or different from the tournament scoring units and the other card reader-writer devices which are provided at the site of play.

In general, the smart cards should be generally available at the various sites or venues where play of a particular athletic event is to be conducted. They are issued by some central issuing authority either in blank with only a permanently imprinted identification, or upon demand with permanently imprinted player specific information. Such smart cards can also be employed to carry and present other information, including, for example, membership, financial transaction, credit, medical information, or the like, if desired.

The electronic recording information can be transmitted directly to a collection device at the site of play so that it is not necessary to carry this information on the smart card from the mobile electronic scoring device to the collection device, if desired.

The term "smart card" is intended to cover all manner of read-write capable devices without regard to the specific manner in which the recording or writing of information is accomplished, or the media upon which the record is imprinted. Preferably, the smart card is a read-write storage device which is capable of receiving and storing information in a readable form, but does not include within it any display or printout capability, and requires an external device to read it. Such a storage device is very small and convenient to carry and manipulate. Typically, such storage devices comprise a card which is approximately the same size and shape as a conventional credit card. In one convenient form the card includes an electronic chip which receives and stores in readable form the information which is imprinted on the card. Smart cards can be presented to a reader or writer for reading or imprinting in a variety of ways. For example, the card can be exposed to a read-write device which reads and/or imprints data optically, magnetically, sonically, or the like.

The use of a small, convenient smart card, according to the present invention, permits the keeping of very extensive, timely, accurate, permanent and complete records of athletic undertakings. It also makes possible the detailed analysis of such information. This adds significantly to the enjoyment of these undertakings, as well as to improved proficiency in carrying them out.

Other objects, advantages, and novel features of the present invention will become apparently from the following detailed description of the invention when considered in conjunction with the accompanying drawings.

BRIEF DESCRIPTION OF THE DRAWINGS

The present invention provides its benefits across a broad spectrum of athletic endeavors. While the description which follows hereinafter is meant to be representative of a number of such applications, it is not exhaustive. As those skilled in the art will recognize, the basic methods and apparatus taught herein can be readily adapted to many uses. It is applicant's intent that this specification and the claims appended hereto be accorded a breadth in keeping with the scope and spirit of the invention being disclosed despite what might appear to be limiting language imposed by the requirements of referring to the specific examples disclosed.

Referring particularly to the drawings for the purposes of illustration only and not limitation:

FIG. 1 is a flow chart of a preferred embodiment of the invention.

DETAILED DESCRIPTION OF THE PREFERRED EMBODIMENTS

Figure 2:
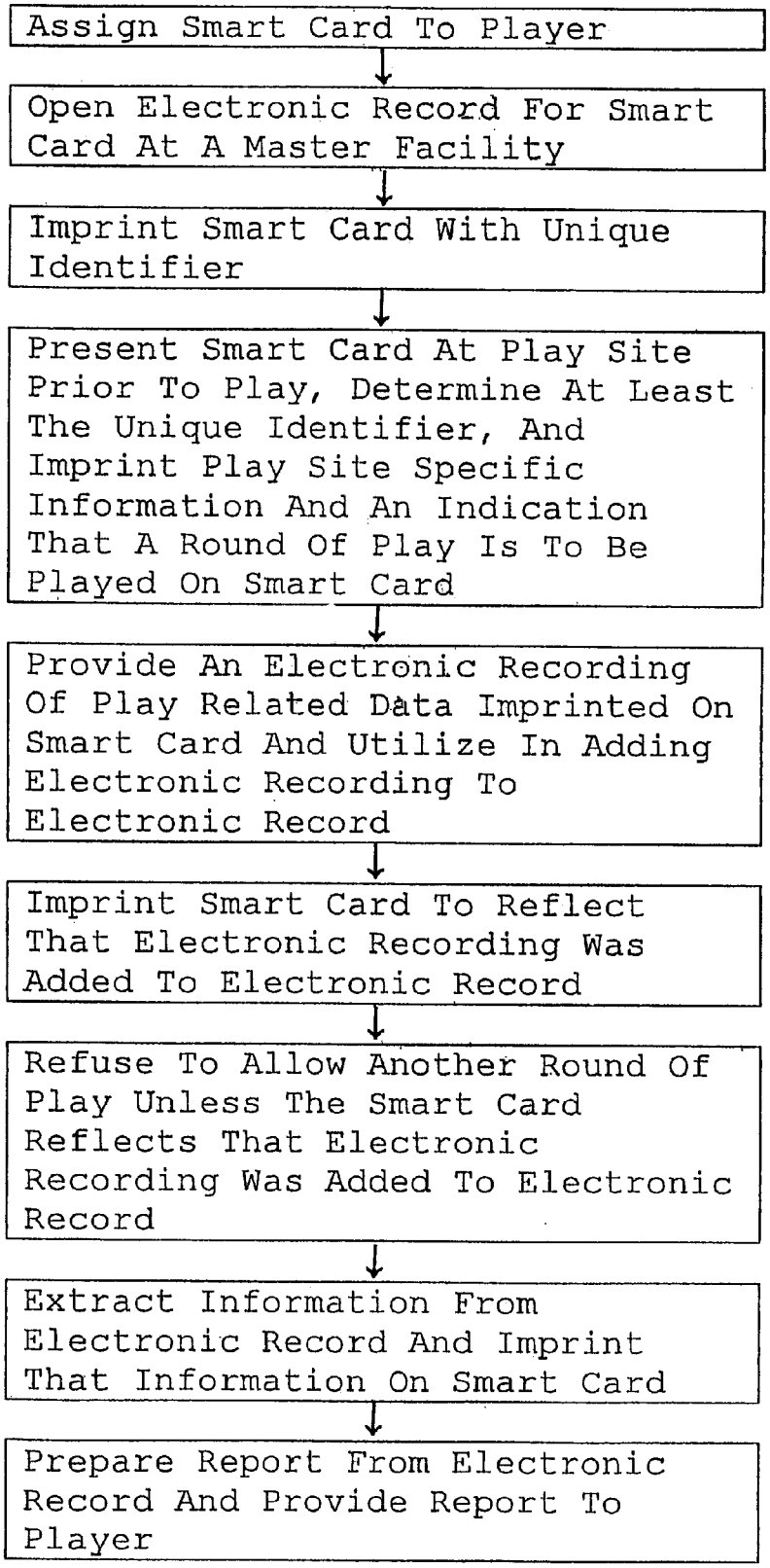
FIG. 2 is a block diagram of a preferred embodiment of the present invention.

Referring particularly to FIG. 1, there is illustrated a preferred flow chart of the principal steps which are carried out in practicing the present invention with respect to, for example, a round of golf. The actions of each of the four participants are arranged under the column which bears that participants name. Actions which are carried out approximately concurrently by the different actors appear in the same rows. In the illustrated embodiment, the Issuing site is different from the Association site, and provides different information extracted from the same data. The Issuing site generally provides personal services to the player with an eye to improving the player's game. The Association is concerned primarily with administering play fairly between all of its members. These two sites can be, and frequently are, however, the same. In such an instance, all of the listed functions are performed by a single entity or master facility, usually from a common database. One such master facility can, for example, operate a single database which includes the current detailed information of each round played by each ranked golfer in the world. Conventional card readers tied to convention PC computers perform most of the computational, recording and writing steps. The construction and programing of mobile scoring units is well within the skill of the art. The issuance of the smart cards is generally managed by a single Issuing site so as to provide integrity for the system. Preferably the smart cards are available at or through the various venues or sites where play is carried out.

A preferred way of practicing the process of the present invention for a player with a previously issued smart card utilizes the smart card to carry information from venue to venue and from location to location within each venue as a particular round of play is carried out. Thus, the smart card is preferably presented at the site of play before play is initiated. The card is imprinted with site specific information and an indicator that a round of play is about to be undertaken. The card is read to determine whether the electronic recording from the last round of play has been downloaded from the card. If the data has not been downloaded, the player is prevented from playing until the information is downloaded. Since the electronic recording is on the smart card, it does not matter whether the last round of play occurred last week at the present site, or last year at a site half way around the world. Prior to the start of play, preferably, the site specific information and any pertinent player specific information is read from the smart card into a mobile score keeping device. This mobile device goes with the players throughout the round of play. As play progresses, the details of play are entered into and stored in the mobile device. At the end of play, or as play progresses, if desired, the electronic recording of the details of play is downloaded from the mobile device onto the smart card. The smart card is preferably then taken to a reader at the site where it is presented and read. As much of the information in the electronic recording as the master facility will accept is then transmitted to it. The reader also records on the smart card the fact that the information has been downloaded to the master facility. The smart card may be updated from information in the electronic record at the master facility to reflect the results of the just concluded round of play, or this reporting may be accomplished at some other time, for example, the next time the card is presented at the start of a round of play. If the downloading step is omitted, it can be accomplished the next time the smart card is presented for a new round of play. If tournament play is involved the data on the smart card may be read into a tournament reader, which can be the same or different form the regular reader. Likewise, if comparisons between players for the just concluded round of play are desired, the respective player's smart cards can be presented to a reader and the desired comparisons generated at the site or at the master facility. The smart card is thus utilized to carry data throughout the process between the various locations where it is required. Its use permits great flexibility in the immediate, accurate, and complete utilization of play specific data for a variety of purposes.

What has been described are preferred embodiments in which modifications and changes may be made without departing from the spirit and scope of the accompanying claims. Many modifications and variations of the present invention are possible in light of the above teachings. It is therefore to be understood that, within the scope of the appended claims, the invention may be practiced otherwise than as specifically described.

What is claimed is:

1. An electronic scoring process for scoring a game, said process comprising:

assigning a smart card to a player, and opening an electronic record for said smart card at a master facility;

imprinting said smart card with at least unique identifying electronic indicia;

prior to initiating a round of play of said game, presenting said smart card at a play site to a play site specific smart card imprinter and reader, determining from said smart card at least the unique identifying electronic indicia and imprinting play site specific information including at least course hole distance data on said smart card and an indication that a round of play is to be played;

providing an electronic recording of play related data concerning said round of play;

imprinting said electronic recording onto said smart card;

utilizing said electronic record on said smart card in adding at least a part of said electronic recording to said electronic record;

imprinting said smart card to reflect that said electronic recording has been added to said electronic record;

refusing said player the opportunity to play another round of play until said smart card reflects that said electronic recording has been added to said electronic record;

extracting information from said electronic record and imprinting said information on said smart card; and preparing a report from said electronic record and providing said report to said player.

2. An electronic scoring process of claim 1 including establishing a second electronic record and adding said electronic recording to both said electronic record and said second electronic record.

3. An electronic scoring process of claim 1 including adding said electronic recording to said electronic record after said round of play.

4. An electronic scoring process of claim 1 including providing said electronic recording of play related data as said round of play is carried out, imprinting said electronic recording on said smart card after said round of play, and transmitting said electronic recording from said smart card to said electronic record.

5. An electronic scoring process of claim 1 including maintaining a plurality of electronic records for a plurality of players, calculating each such player's standing as against said plurality of players and reporting such standings.

6. An electronic scoring process of claim 1 wherein said round of play is a round of golf.

* * * * *